United States Patent [19]

Wickman et al.

[11] Patent Number: 4,683,731

[45] Date of Patent: Aug. 4, 1987

[54] LATCHING DEVICE

[75] Inventors: John A. Wickman, Swansea, Mass.; John J. Killian, III, Warren, R.I.

[73] Assignee: American Tourister, Inc., Warren, R.I.

[21] Appl. No.: 771,304

[22] Filed: Aug. 30, 1985

[51] Int. Cl.[4] ..... E05B 65/52

[52] U.S. Cl. ..... 70/69; 70/71; 70/72; 292/241; 292/209; 292/106

[58] Field of Search ..... 70/71, 67, 69–70, 70/72–76; 292/207, 209, 241, 359, 106

[56] References Cited

U.S. PATENT DOCUMENTS

| | | | |
|---|---|---|---|
| Re. 29,897 | 2/1979 | Heine et al. | 70/71 |
| 1,080,832 | 12/1913 | Isidor | 292/209 |
| 2,399,302 | 4/1946 | Thiele | 292/106 X |
| 3,020,742 | 2/1962 | Gehrie | 70/69 |
| 3,188,839 | 6/1965 | Humphries | 70/70 |
| 3,377,093 | 4/1968 | Macolicz | 292/241 |
| 3,390,555 | 7/1968 | Bloss | 70/69 |
| 3,390,556 | 7/1968 | Constable | 70/75 |
| 3,412,832 | 11/1968 | Jamison et al. | 292/207 X |
| 3,908,416 | 9/1975 | Heine et al. . | |
| 4,095,829 | 6/1978 | Van Klompenburg | 292/241 |
| 4,235,465 | 11/1980 | Costello | 292/241 X |

FOREIGN PATENT DOCUMENTS

| | | | |
|---|---|---|---|
| 624266 | 8/1961 | Italy | 70/75 |

*Primary Examiner*—Robert L. Wolfe
*Assistant Examiner*—Suzanne L. Dino

[57] ABSTRACT

A latching device for luggage is described, wherein a latching member having a hasp engaging angled finger is rotatably mounted in a frame member. A spring member rotatably mounted atop the latching member has a key receiving recess, a locking tab for preventing rotation of the latching member, serves to urge the latching member against the base member and yieldably holds a ball in recesses in the base member. A hasp has a boss with a curved slot for receiving the hasp engaging finger on the latching member. A cover plate is rigidly attached to the latching member and is rotatably disposed on a base member which has a raised rib. A side wall of the cover plate rides across the rib camming the latching member and angled finger upwardly against a wall of the slot to draw the hasp and latching device toward each other.

13 Claims, 9 Drawing Figures

Fig. 4
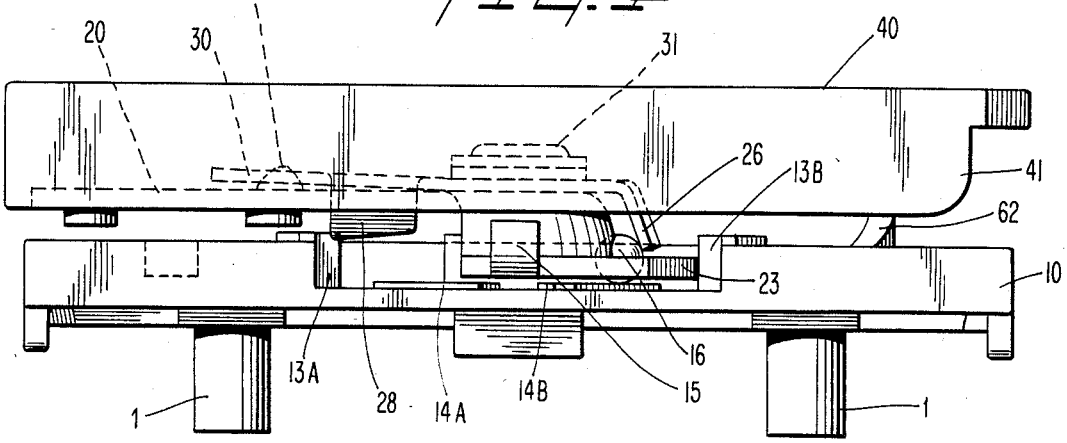
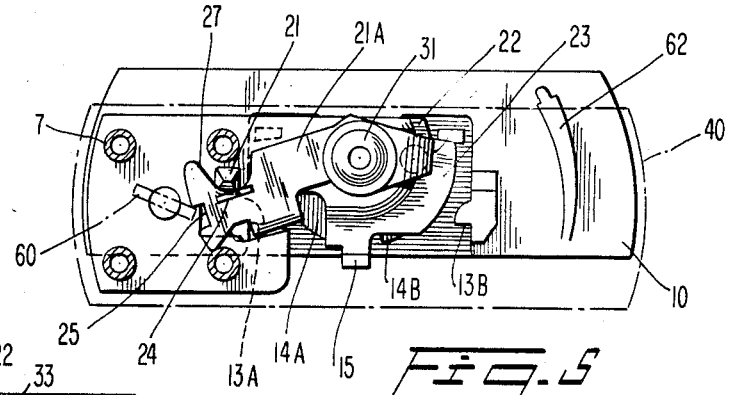
Fig. 5
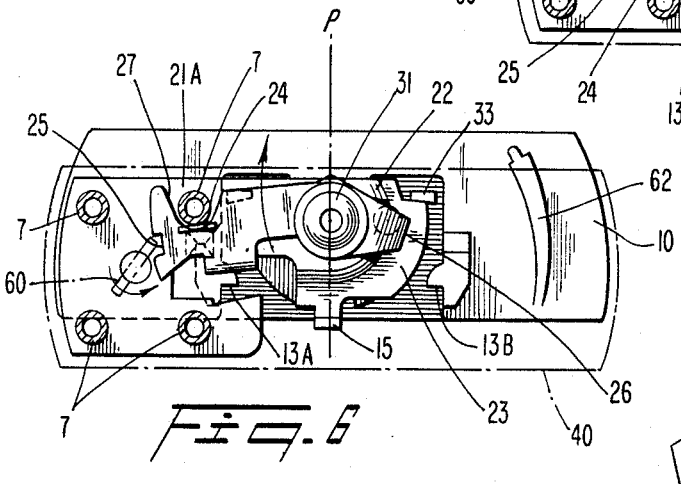
Fig. 6
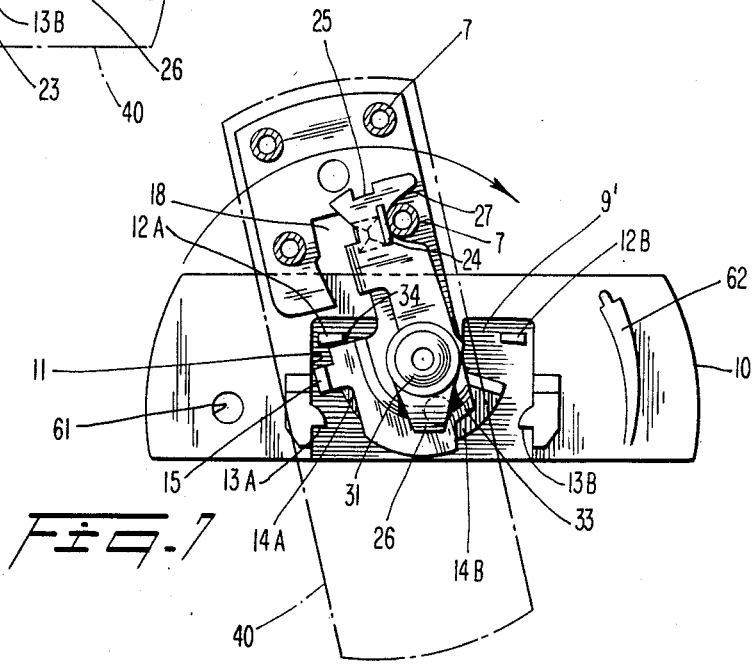
Fig. 7

LATCHING DEVICE

BACKGROUND OF THE INVENTION

The invention relates to latching devices of the type used to latch and/or lock luggage or other portable containers that include separable sections hinged on one side. On the other side, one or more latches on one of the sections engage corresponding hasps on another section to securely latch and/or close the luggage.

One type of latching device having a latch member that rotates into and out of engagement with a hasp member is described in U.S. Pat. No. 3,908,416 granted Sept. 30, 1975 and a reissue of that patent, U.S. Pat. No. Re. 29,897 granted Feb. 6, 1979. In that device, a rectangular latch member having downwardly extending sidewalls, when rotated to the closed position, engages a hasp with one of the sidewalls. The latch member is rotated 90 for disengagement of the hasp. A leaf spring urges the latch member into engagement with a mounted frame and serves to provide a force to releasably hold the latch member in either an open or closed position. A similar latching device is described in U.S. Pat. No. 3,020,742 granted Feb. 13, 1962. In that patent, a leaf spring urges a rotatable latching member into engagement with a base member and, in conjunction with a ball being held beneath the leaf spring and movable into detents, yieldably holds the latching member in either the open or closed position.

OBJECTS AND SUMMARY OF THE INVENTION

The present invention has, for an object, an improved latching device simpler in construction and having fewer parts than the devices referred to above.

A further object is the provision of a latching device having a rotatable hasp engaging member that is yieldably held in an open or closed position.

Another object is the provision of a novel spring means, which in conjunction with the rotatable latching member, can be key actuated to lock and unlock the latching member into engagement with a hasp.

Yet another object of the invention is a hasp having an inner curved surface engaged by an angled locking finger of the latching member and serving to draw the pivotable sections of a luggage device together.

These and other objects of the invention are accomplished by a simple design of a base plate to be attached to luggage, having an upstanding projection for rotatably mounting a latch member and a spring member and a raised rib on an upper surface for engagement by a cover plate to cam a locking finger upwardly to draw a hasp toward the base plate; a latch member rotatably mounted on the projection and having a hasp engaging locking finger thereon; a spring member rotatably mounted on the projection over the latch member and a ball held against the base by the spring member. The spring member serves in conjunction with the ball and detents in the base, to yieldably hold the latch member in the open and closed positions. The spring member includes a locking tab for preventing the rotation of the latch member and the movement of the locking finger from disengagement with the hasp, and a recess for engagement with a key for moving the locking tab of the spring member out of locking engagement with the latch member. Rotation of the cover plate which is firmly attached to the spring member causes rotation of the spring member and latch member. As a sidewall of the cover plate engages the raised rib on the base plate, the cover plate, spring member and latch member are cammed upwardly, thereby raising the locking finger, which is in engagement with a wall of a slot in the hasp, to cause the hasp to be drawn toward the latching device.

In addition to the above noted objects, other advantages of the invention will become apparent from the detailed description given below of a preferred embodiment.

BRIEF DESCRIPTION OF THE DRAWINGS

FIG. 4 is a side elevational view of the latching device with the spring member in the locked position;

FIG. 5 is a top elevational view of the latching device with the cover plate removed and the spring member in the locked position;

FIG. 6 is a top elevational view of the latching device with the cover plate removed and the spring member in the unlocked position;

FIG. 7 is a top elevational view of the latching device with the cover removed and the latching member rotated out of engagement with the hasp.

DETAILED DESCRIPTION

Figure 1:
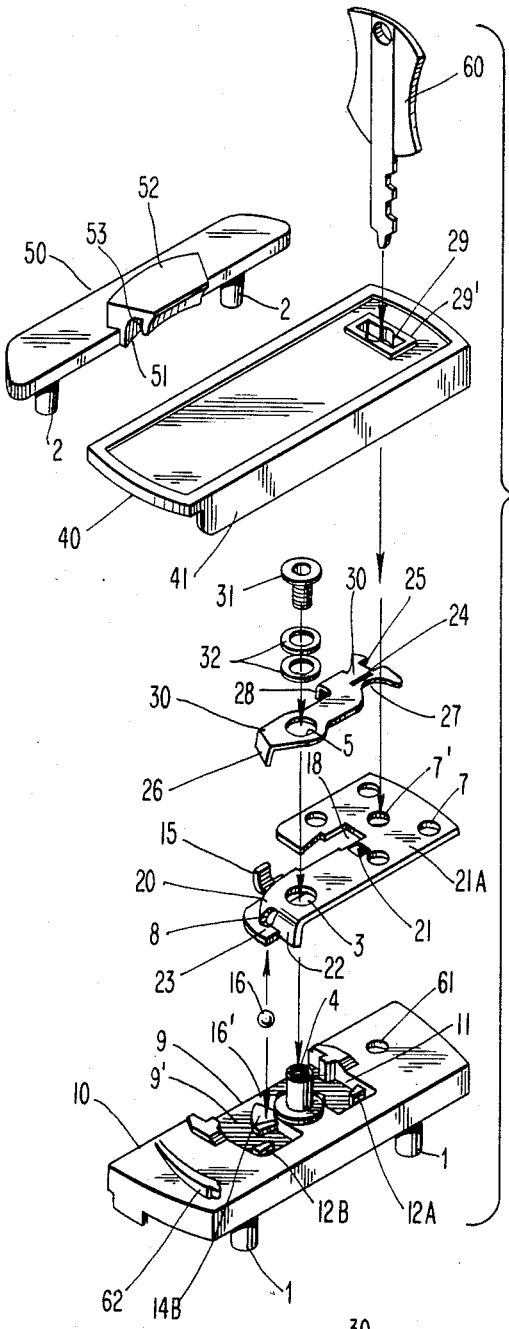
FIG. 1 is an exploded perspective view of the parts of the latching device, a hasp, a key and a cover plate.
Figure 2:
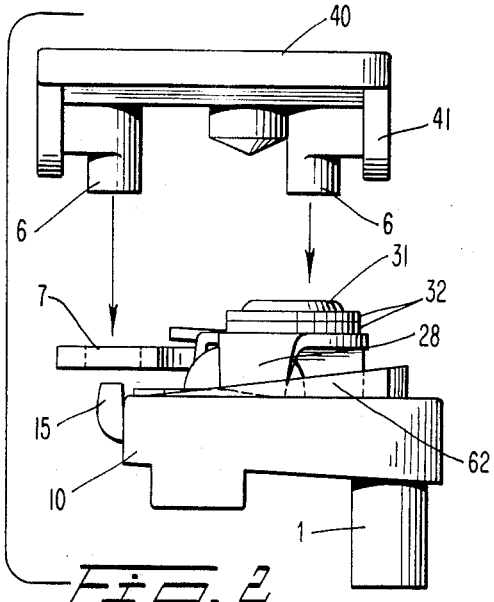
FIG. 2 is an exploded elevational end view of the latching device and cover plate.
Figure 3:
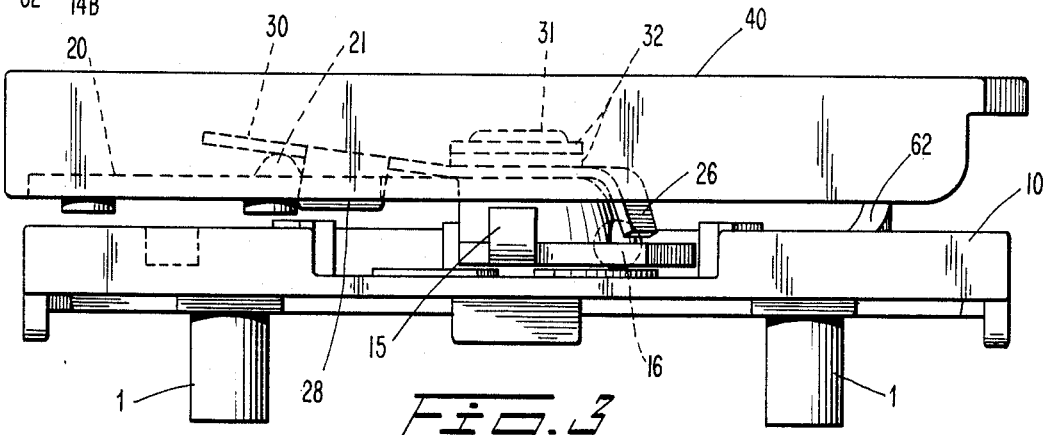
FIG. 3 is a side elevational view of the latching device with the spring member in the unlocked position.

FIG. 1 illustrates a frame or base member 10 with projections 1 for attachment to a section of a luggage device and a hasp 50 with projections 2 for attachment to the other section of a luggage device. A latch member 20 is rotatably mounted on the frame member via a hole 3 which receives an upstanding hollow projection 4 on the base member. Spring member 30 is rotatably mounted above the latch member 20 via a hole 5 which receives the upstanding projection 4. A suitable means such as a nut 31 and washers 32 attach the spring member and latch member to the base. The nut 31 has external screw threads which mate with internal screw threads within the projection 4. In lieu of a nut, the upper portion of the upstanding projection could be rolled over to form a flange for holding the parts 30 and 20 of the latch onto the base. A cover plate 40 is attached to latch member 20 via four posts 6, two of which are shown in FIG. 2. Posts 6 are inserted into holes 7 of latch member 20 and attached in any suitable manner e.g., by rivets. Thus, a unit comprising the latch member 20, the spring member 30 and the cover 40 is rotatable about an axis defined by the projection 4. A locking finger 15 on the latch member 20 is bent upwardly at an angle and is operable to enter a curved cam slot 51 in a boss 52 of the hasp 50 to pull the latter closed. A ball 16 is caged in a hole 8 of latch member 20 by means of a downwardly bent tab 26 of the spring 30 (FIG. 3).

Base or frame member 10 has a recessed portion 9 having a floor 9' and a pair of parallel sidewalls 11 (FIGS. 1 and 7). Stop projections 12A and 12B extend upwardly from floor 9'. Stop shoulders 13A, 13B extend upwardly from floor 9' and inwardly from sidewalls 11.

Ball riding ramps 14A, 14B project upwardly from floor 9' and extend in an arc around projection 4. A ball receiving recess 16' is situated between the two ramps. The base member is symmetrical about a plane P (FIG. 6) through the center of projection 4 and parallel to the parallel sides 11. On one side of the upper surface of the base member is a key receiving recess 61. The other side of the upper surface has a raised rib portion 62.

Only one of the ramps 14A, 14B is used per given latch. That is, the base member 10 is suitable for use with right-hand or left-hand latch members wherein either one or the other ramp members 14A, 14B is actually utilized. In the presently disclosed embodiment, only the ramp 14B is utilized. The ball 16 is biased downwardly by the tab 26 and thus resists entry onto the ramp 14B. Hence a slight amount of effort is required to rotate the latch member out of the latching position of FIG. 5 and the unlatching position of FIG. 7 in which positions the ball 16 contacts the floor 9' rather than the ramp 14B. Preferably, the ends of the ramps 14A, 14B located adjacent the stop projections 12A, 12B are higher than at the opposite ends so that more resistance is encountered when initiating an unlatching procedure.

The latch includes an upper flat surface 21A and a downwardly curved portion 22 terminating in an arcuate flat portion 23 which is disposed within the recessed portion 9 of the base member 10. The locking finger 15 extends upwardly from the portion 23. The hole 8 is partially formed in the curved portion 22 and partially in flat portion 23. Rotary forces for rotating the latch are applied to the upper flat surface 21A of the latch member by the cover 40, whereby the latch member rotates about the axis of the projection 4. The arcuate flat portion 23 rotates within the recess 9 between latching and unlatching positions. In the latching position a shoulder 33 of the arcuate flat portion abuts against the stop projection 12B (FIGS. 6 and 7) and in the unlatching position, a shoulder 34 of the arcuate portion 23 engages the stop projection 12A (FIG. 7).

The spring 30 has a downwardly bent locking tab or flange 28 which is received in a slot 18 of the latch member. The spring 30 is relatively pivotable relative to the latch about the axis of the projection 4 to a limited extend defined by movement of the locking tab 28 within the slot 18. One end of the spring is arranged to ride upon a camming ramp 21 which projects upwardly from the flat upper surface 21A of the latch member. The spring member 30 has a downwardly extending indentation 24 that forms a cam riding projection for riding up and over the ramp 21 of the latch member. A cut-out section 25 in the spring forms a key receiving recess. That is, a key 60 inserted through a keyhole 29 in an upraised section 29' of the cover has its tip received in a hole 7' in the latch member and into recess 61 of the base member to define an axis of rotation for the key, and a tooth on the key enters the cut-out 25 in the spring. Consequently, as the key is rotated, the spring is rotated about the axis of the projection 4 so that the spring moves either onto or off the camming ramp 21. When the spring moves onto the ramp 21, the locking tab 28 is raised (FIG. 6), and when the spring moves off the ramp 21 the locking tab 28 is lowered (FIG. 5). When the locking tab is lowered (FIG. 5), and end thereof overlaps the stop shoulder 13A (FIG. 4) and thus will abut thereagainst if rotation of the latch to an unlatching position is attempted. Thus, by moving the spring off the ramp 21 the latch is locked. The downwardly bent tab 26 of the spring serves to bias the ball 16 against the bottom surface of the recessed portion 9 in the base member 10, as noted earlier. A cut-out section 27 in the spring forms a recess for receiving and stopping against a post 6 of the cover plate.

It will be appreciated that the spring bears against the latch member 20 to aid in biasing the latch member against the base member.

Figure 8:
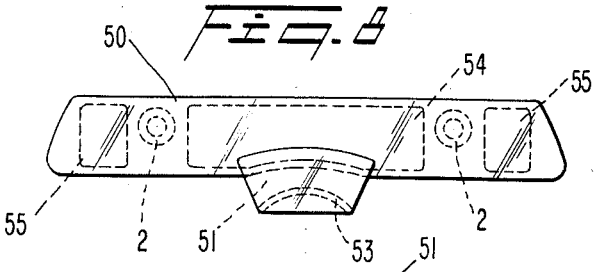
FIG. 8 is a top elevational view of the hasp.
Figure 9:
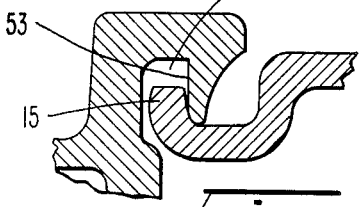
FIG. 9 is a cross-sectional view of a section of the hasp being engaged by the locking finger.

Referring to FIGS. 1, 8 and 9, hasp 50 has a large hollow section 54 and two smaller sections 55. Posts 2 separate the large hollow section 54 from a respective smaller hollow section 55. Inner wall 53 of slot 51 is engaged by locking finger 15 of latch member 20 when the latch is rotated to the closed position. Rotation of the cover plate to the closed position causes side 41 to engage rib 62 on the base member. The rib is of progressively increasing height so that as the side 41 of the cover plate rides along the rib 62, latch member 20 along with locking finger 15 is cammed upwardly causing the locking finger to move upwardly in slot 51 of the hasp and engage sidewall 53 to thereby draw the hasp toward the latching device.

The operation of the latching device will now be described. Referring to FIG. 6, the latching member 20 is in the unlocked position because the spring is disposed on the ramp 21 of the latching member. In this position locking tab 28, see FIG. 3, has been moved up and out of engagement with stop shoulder 13A of the base member. In the position illustrated in FIG. 6, the latch can be freely rotated to move the locking finger 15 into and out of engagement with the curved slot 51 of the hasp 50. The latching member is yieldably held in the latched position by the spring force of bent tab 26 of spring member 30 acting on ball 16, see FIG. 3. When the cover plate, latching member and spring are rotated toward the unlatched position, see FIG. 7, a slight force is required to move ball 16 upon the ramps 14B of the base member. In moving to the fully unlatched position, the ball travels in an arcuate direction the latching member to be yieldably held in the unlatched position. Rotation of the cover plate, spring member and latch member back into the latched position of FIG. 6 causes the ball to move back upon the ramp 14B, across the ramp and down into the recess on the other side of the ramp. The stop projections 12A, 12B limit the rotation of the latching member in either direction.

The latching device is locked by inserting a key through the cover plate so that the tip of the key rests in hole 61 of the member 10 and a tooth of the key fits within the recess 25 of the spring member 30. The key is turned clockwise to rotate the spring member counterclockwise about the axis of the projection 4 to the position shown in FIG. 5. In this position, the spring has moved off the ramp 21 of the latching member, and the downwardly extending tab 28 has moved into engagement with stop projection 13A, see FIG. 4. The engagement of tab 28 with stop projection 13A locks all elements against rotation in the unlatching direction. To disengage the locking finger 15 from the hasp, the key must be reinserted and turned to move the spring member 30 so that the spring rides up onto the ramp 21. This movement causes the projection 24 on the spring member 30 to lift tab 28 up and out of engagement with stop projection 13A. Once tab 28 is out of engagement with the stop projection 13A, the latching member is free to rotate, and the locking finger 15 can be moved out of engagement with the hasp.

It will be appreciated that a lock according to the present invention operates with significantly fewer parts than prior art locks of this type. In this regard, it will be appreciated that the spring member performs a multiplicity of functions, viz., as a carrier for the locking tab 20, as a means for biasing the ball 8, and as a means for biasing the latch against the base.

It will also be appreciated that the angled locking finger moving upwardly in the curved slot of hasp against the wall of the slot functions to draw the hasp and latching device toward each other.

While there has been shown and described what is considered to be the preferred embodiment of the present invention, it will be appreciated by those skilled in the art that modifications of such embodiment may be made. It is therefore desired that the invention not be limited to the preferred embodiment, and it is intended to cover in the appended claims all such modifications as fall within the true spirit and scope of the invention.

What is claimed is:

1. A latching device for engaging a hasp, comprising:

a base frame having a stop shoulder;

a manually operable latch member pivotally mounted to said base frame for rotation relative thereto about an axis of rotation, said latch member having a hasp engaging finger;

a spring member pivotally mounted for rotation relative to said latch member and said base frame about said axis of rotation, said spring member having a flange means and means for being engaged by a key for rotating said spring member such that said flange means is moved to a position for lockingly engaging said stop shoulder and locking said latch member against movement in a hasp disengaging direction.

2. A latching device as set forth in claim 1 including a ball rotatably mounted in said latch member and engageable with said base frame to offer resistance to movement of said latch member relative to said base frame, said spring member including a portion yieldably biasing said ball against said base frame.

3. A latching device as set forth in claim 2, and further comprising:

a curved downwardly extending section on said latching member and a flat arcuate projection extending from said section, a hole partially formed in said section and partially formed in said flat arcuate projection;

a recessed floor portion on said base frame, an arcuate ramp on said floor;

said portion of said spring member comprising a downwardly extending tab;

said ball received in said hole and urged against the floor of said base frame by said downwardly extending tab on said spring member, whereby rotation of the latching member is yieldably resisted by said ball, spring and arcuate ramp from either a latched or unlatched position.

4. A latching device as set forth in claim 1, and further comprising:

a key receiving recess in said spring member defining said key-engaging means; and means on said latch member for lifting said flange means up and out of locking engagement when the spring member is rotated to an unlocked position by a key.

5. A latching device as set forth in claim 4, wherein said means for lifting said flange means comprises a cam in the form of a ramp section integral with said latch member.

6. A latching device as set forth in claim 5, and further including:

a downwardly extending cam riding projection on said spring member, said cam riding projection disposed to ride up and over said ramp section when said spring member is rotated by a key.

7. A latching device as set forth in claim 1, including an upstanding projection carried by said base frame and defining said axis of rotation.

8. A latching device, comprising the combination of: a hasp having a boss formed thereon, a slot undercut in said boss having a curved camming surface;

a rotatable latching member including an angled finger; a base frame having a stop shoulder; and means for moving said finger upwardly for engagement with said curved camming surface to draw said hasp and latching device toward each other, said means including a spring member, pivotably mounted for rotation relative to said latching member and said base frame about an axis of rotation, having a flange means for locking said latching means against rotation in a direction for disengagement of said angled finger with said curved camming surface of said hasp, said spring member further including means for being engaged by a key for rotating said spring member such that said flange means is moved to a position for lockingly engaging said stop shoulder.

9. A latching device as set forth in claim 8, and further comprising:

a key receiving recess in said spring member defining said key-engaging means; and means on said latch member for lifting said flange means up and out of locking engagement when the spring member is rotated to an unlocked position by a key.

10. A latching device as set forth in claim 9, wherein said means for lifting said flange means comprises a cam in the form of a ramp section integral with said latch member.

11. A latching device as set forth in claim 10, and further including:

a downwardly extending cam riding projection on said spring member, said cam riding projection disposed to ride up and over said ramp section when said spring member is rotated by a key.

12. A latching device as set forth in claim 8, including an upstanding projection carried by said base frame and defining said axis of rotation.

13. A latching device as set forth in claim 8, wherein said means for raising said finger includes a rib on an upper surface of said base frame about which said latching member is rotatably disposed and a cover plate having a sidewall for engagement with said rib when said latch member is rotated.

* * * * *